US010378834B2

(12) United States Patent
Abell et al.

(10) Patent No.: US 10,378,834 B2
(45) Date of Patent: Aug. 13, 2019

(54) TUBE HEADER FOR HEAT EXCHANGER

(71) Applicant: MAHLE International GmbH, Stuttgart (DE)

(72) Inventors: Bradley D. Abell, Clarkston, MI (US); Nicholas Potter, Livonia, MI (US)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 170 days.

(21) Appl. No.: 15/134,584

(22) Filed: Apr. 21, 2016

(65) Prior Publication Data

US 2017/0010059 A1 Jan. 12, 2017

Related U.S. Application Data

(63) Continuation-in-part of application No. 14/793,135, filed on Jul. 7, 2015.

(51) Int. Cl.

| | |
|---|---|
| ***F28F 9/18*** | (2006.01) |
| ***F28F 9/02*** | (2006.01) |
| ***F28D 1/053*** | (2006.01) |
| ***F28F 1/12*** | (2006.01) |
| ***F28F 9/013*** | (2006.01) |

(Continued)

(52) U.S. Cl.

CPC ..... *F28F 9/182* (2013.01); *F28D 1/05366* (2013.01); *F28D 1/05375* (2013.01); *F28F 1/12* (2013.01); *F28F 9/013* (2013.01); *F28F 9/0202* (2013.01); *F28F 9/0209* (2013.01); *F28F 9/0224* (2013.01); *F28F 9/0226* (2013.01); *F28F 9/0268* (2013.01); *F28D 2021/0094* (2013.01); *F28F 2009/0297* (2013.01);

(Continued)

(58) Field of Classification Search

CPC ..... F28F 9/0246; F28F 9/0224; F28F 9/18; F28F 2255/02; F28F 2265/26; F28F 9/182; F28D 1/05366

See application file for complete search history.

(56) References Cited

U.S. PATENT DOCUMENTS 5,676,200 A * 10/1997 Laveran ..... F28F 9/18 165/173
6,446,337 B1 * 9/2002 Halm ..... F28F 9/182 29/527.2

(Continued)

FOREIGN PATENT DOCUMENTS

DE 10250441 A1 5/2004
DE 102006057032 A1 6/2008

(Continued)

*Primary Examiner* — Jon T. Schermerhorn, Jr.
(74) *Attorney, Agent, or Firm* — Brinks Gilson & Lione

(57) ABSTRACT

A tube header for a heat exchanger includes a header plate having two major dimensions defining a header plane. The header plate has a row of oblong passages extending through the header plate, and a plurality of tie bars. Each tie bar is arranged between a pair of adjacent oblong passages. At least one of the tie bars is a support tie bar with a generally W-shaped support tie bar profile in a cross-section across the row of oblong passages. The support tie bar has a center area forming a plateau surface parallel to the header plane and connecting two generally V-shaped portions of the support tie bar profile. The plateau surface supports an internal header baffle extending perpendicular to the header plane.

19 Claims, 5 Drawing Sheets

(51) Int. Cl.
*F28D 21/00* (2006.01)
*F28F 9/22* (2006.01)

(52) U.S. Cl.
CPC ..... *F28F 2009/224* (2013.01); *F28F 2230/00* (2013.01); *F28F 2265/26* (2013.01)

(56) References Cited

U.S. PATENT DOCUMENTS

| | | | | |
|---|---|---|---|---|
| 7,007,745 | B2 * | 3/2006 | Iwasaki | F28F 9/0226 165/173 |
| 7,406,929 | B2 | 8/2008 | Hassdenteufel et al. | |
| 2005/0167091 | A1 * | 8/2005 | Juschka | F28D 7/1684 165/173 |
| 2008/0000626 | A1 | 1/2008 | Sugito et al. | |
| 2012/0247742 | A1 * | 10/2012 | Mizuno | F28F 9/0209 165/173 |
| 2013/0160973 | A1 * | 6/2013 | Riondet | F28F 9/0224 165/104.19 |
| 2015/0159963 | A1 | 6/2015 | Ghiani et al. | |

FOREIGN PATENT DOCUMENTS

| | | | | |
|---|---|---|---|---|
| GB | 2453128 | A * | 4/2009 | F28F 9/02 |
| JP | S6478672 | A * | 3/1989 | |
| WO | 2007/042182 | A1 | 4/2007 | |

* cited by examiner

TUBE HEADER FOR HEAT EXCHANGER

TECHNICAL FIELD OF THE INVENTION

The present application relates to a tube header of a heat exchanger and to a heat exchanger with such a tube header.

BACKGROUND

Heat exchangers are used to transfer heat from one fluid to another fluid. Heat exchangers have various uses within an automotive vehicle. For example, in a radiator, heat is transferred from a cooling liquid to the ambient air. In particular in motor vehicles the heat exchanger is used to discharge waste heat released by the internal combustion engine into the ambient air. The cooling medium that flows through the heat exchanger may be a liquid or, in some applications, a gaseous fluid.

Heat exchangers of the radiator type include a plurality of parallel tubes and two header boxes. The header boxes are typically multi-part structures having a header tank and a tube header. The tube header includes a central header plate with passages bordered by side walls forming a ferrule. The ends of the tubes are inserted into the ferrules to establish a fluid communication between the tube header and the interior volume of the tubes. The tubes may be formed from folded or welded sheet metal. While welded tubes are generally more durable, folded tubes are less costly to manufacture.

During operation, the service life of the heat exchanger may be shortened due to non-uniform expansion of the individual components of the heat exchanger when heating up and cooling down and the deformation or displacement resulting therefrom. The stresses can be attributed to the changing thermal conditions in the heat exchanger. The service life of a heat exchanger may thus be shorter for heat exchangers with folded tubes than for those with welded tubes.

In the past, attempts have been made to extend the service life of heat exchangers by modifying the transition between the tube header and the inserted folded tubes, with limited success.

SUMMARY OF THE INVENTION

It is therefore an object of the present application to provide a tube header for a heat exchanger in which the service life of the heat exchanger is extended without detriment despite the use of economically manufactured tubes.

According to an embodiment of the invention, a tube header for a heat exchanger comprises a header plate having two major dimensions defining a header plane, the header plate having a row of oblong passages extending through the header plate. Between adjacent passages, the header plate includes tie bars for a corrugation effect resulting in improved dimensional stability against warping. At least one of the tie bars has a generally W-shaped profile in a cross-section across the row of oblong passages. As will be explained below, this structure is mostly beneficial in heat exchangers having multiple zones.

Preferably, the tie bar with the W-shaped profile has a center area forming a plateau surface parallel to the header plane and connecting two generally V-shaped portions of the profile of the tie bar. The plateau can provide a sealing surface for a baffle in a multi-zone heat exchanger.

Each passage is preferably bordered by a ferrule monolithically formed with the header plate. Each of the generally V-shaped portions of the tie bar profile has an outer tie bar side wall connected to an adjacent ferrule and an inner tie bar side wall connected to the center area.

Preferably, the plateau surface defines a plateau plane intersecting the length of the ferrule that extends perpendicular to the header plane.

In an installed position, the center area is located further inside the header tube than an outermost portion of the tie bar.

For structural robustness, the center area preferably has a thickness corresponding to a maximum thickness of the tie bar.

Further, in an installed position, the plateau surface supports an internal header baffle extending perpendicular to the header plane. A gasket bridge may be sealingly disposed along the support tie bar and forms a seal between the support tie bar and the internal header baffle Between the remaining adjacent passages, the header plate preferably includes trough-shaped tie bars. For this purpose, the tie bars may have side walls with a side wall thickness that is greater than the wall thickness of the ferrules.

The ferrule has a surrounding wall extending perpendicular to the header plane. A transitional area between the ferrule and the header plate has a reduced thickness that is smaller than the wall thickness of the ferrule. This transitional area provides a flexible hinge-like function for compensating dimensional changes during thermal cycles of a heat exchanger.

The center area may have a center area thickness that is greater than the wall thickness of the ferrule. This provides flexibility to the ferrule.

Conversely, reduced thickness of the transitional area may amount to at most 50% of the maximum thickness. This ensures structural robustness to the support tie bar.

For example, in relative terms, the center area may have a center area thickness that is greater than the wall thickness of the ferrule.

Likewise, the trough-shaped tie bar may have side walls with a side wall thickness that is greater than the wall thickness of the ferrules. Preferably, however, the trough-shaped tie bar has a bottom thickness that is smaller than the side wall thickness to provide an accordion-like flexibility to the trough-shaped tie bars.

According to a further aspect of the invention, the header plate may have at least one attachment portion for affixing the tube header to a header tank, wherein the attachment portion extending perpendicular to the header plane in the same direction as the ferrules.

According to a further aspect of the invention, an assembled heat exchanger has at least one header box and a plurality of tubes extending therefrom. The header box comprises a tube header having a header plate defining a header plane with a row of oblong passages extending through the header plate, and a plurality of tie bars, each tie bar arranged between a pair of adjacent oblong passages. At least one of the tie bars is a support tie bar with a generally W-shaped support tie bar profile in a cross-section across the row of oblong passages. The W-shaped tie bar provides a suitable sealing surface for a header baffle in a multi-zone heat exchanger.

The tubes may be folded sheet metal tubes. Each of the ferrules has a length perpendicular to the header plane and terminates in a remote edge at a free end. Preferably, the plateau defines a plateau plane that intersects the length of each ferrule.

The heat exchanger may include an internal header baffle supported by the support tie bar.

A header tank may form a header box in cooperation with the tube header. The header box accommodates the internal header baffle.

Further aspects and benefits of the present invention will become apparent from the following detailed description of the attached drawings. However, the detailed description and the specific examples shown in the drawings are provided for illustrative purposes only and are not intended to limit the scope of the present invention

DETAILED DESCRIPTION

Figure 1:
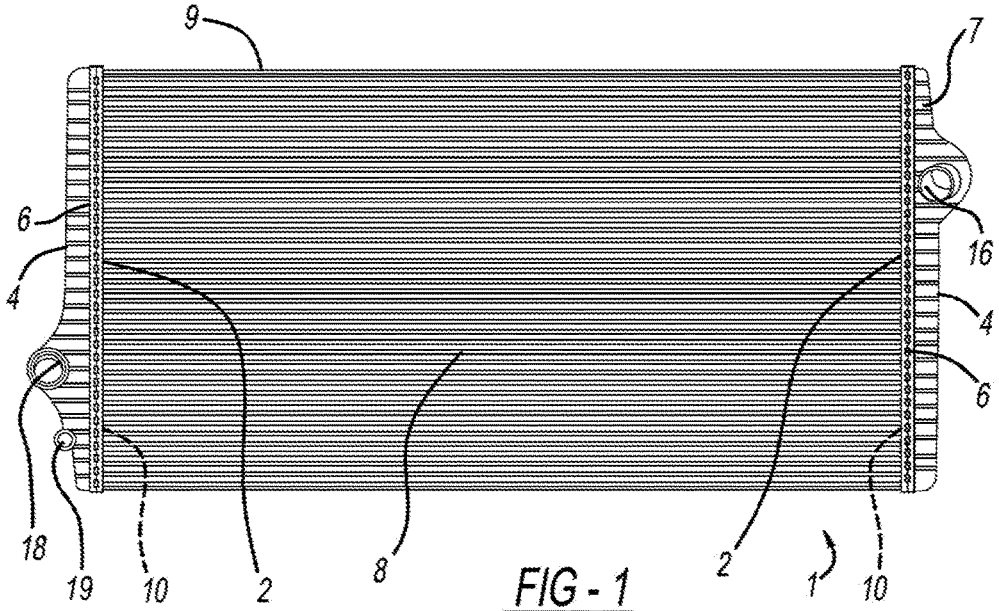
FIG. 1 is a perspective view of a heat exchanger according to one aspect of the present invention.

FIG. 1 shows a heat exchanger 1 that has two opposing tube headers 2. Each tube header 2 is attached to a header tank 4 indicated in broken lines. The tube headers 2 and the header tanks 4 form two header boxes 6 on opposite ends of the heat exchanger 1. The shape of the header tanks 4 is dictated by the architecture of the vehicle, in which the heat exchanger 1 is to be installed, and the indicated header tanks 4 only constitute a general schematic representation of header tanks 4 that may have different shapes and may have additional features, for example for installation of the heat exchanger 1 in a vehicle or for attaching sensors to the header tank. The header tanks 4 may be formed from injection-molded plastic that may include reinforcement structures, such as stiffening ribs 7 located on the outside of the header tanks 4.

Arranged between the tube headers 2 are tubes 8 with elongated cross-sections. The tubes 8 are placed adjacent to one another and extend parallel to one another in a row. The tubes 8 have tube ends 10 that pass through passages 12 in the tube header 2 as will be explained in greater detail in connection with FIG. 5. The tubes 8 bring the two header boxes 6 in fluid communication with each other. Cooling fins 14, which are elongated flat metal strips bent in a zigzag or serpentining shape (see FIG. 5), are placed between adjacent tubes 8 for increasing the cooling surface of the heat exchanger 1. The matrix of alternating tubes 8 and cooling fins 14 is bordered at each end by a core cover 9 extending from one tube header 2 to the other and forming an outer surface of the heat exchanger 1.

When the heat exchanger 1 is designed as a radiator, the cooling medium enters an interior of one of the two header boxes 6 through an inlet opening 16 provided in the header box 6. The cooling medium to be cooled distributes itself in the interior, enters the tubes 8, and flows through them. In this process, cooling of the hot cooling medium takes place via the surfaces of the tubes 8 and of the cooling fins 14, and the cooled cooling medium in turn enters an interior of the other header box 6 at the other tube ends 10 of the tubes 8. The other header box 6 contains a first outlet opening 18 of a high-temperature zone and a second outlet opening 19 of a low-temperature zone, through which the cooling medium, which has in the meantime been cooled, is delivered to devices to be cooled. To separate the fluid inside the header box 6 that includes the outlets 18 and 19, an internal header baffle is arranged inside the header box 6 that divides the header box into two separate outlet zones. A schematic illustration of an internal baffle is provided in FIG. 5

For establishing a meandering flow through the pipes, the header boxes 6 may each include one or more further internal header baffles that divide the header boxes into zones. The baffle or baffles on one header box 6 are offset from the baffles of the other header box 6, thereby creating several groups of tubes with a reversal of the flow direction from one group of tubes to an adjacent group of tubes.

The tubes 8 and the cooling fins 14 located between them are exposed to a cooling air flow. In this process, the heat energy of the hot cooling medium flowing through the tubes 8 is transferred to the surfaces of the tubes 8 and from there to the cooling fins 14, and is then carried away by the cooling air flow.

Figure 2:
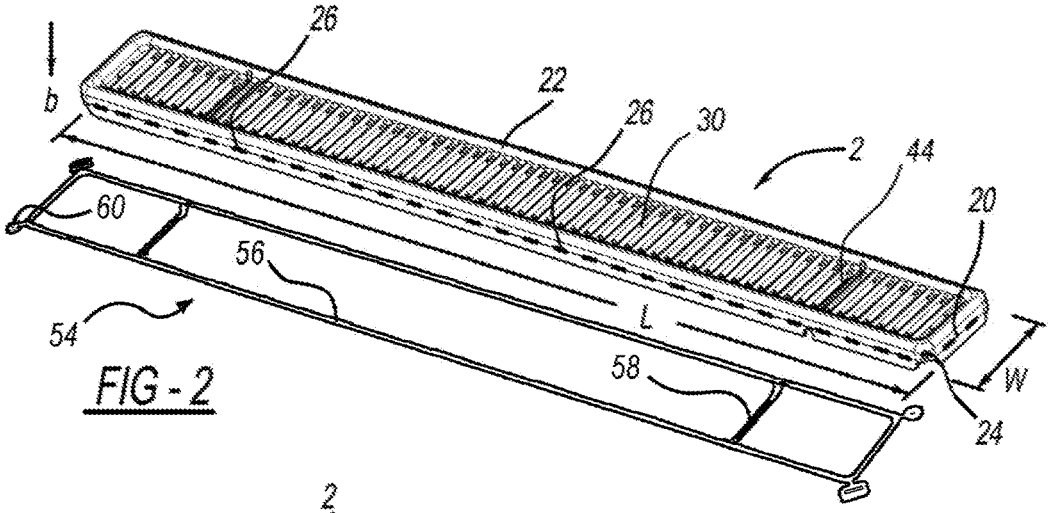
FIG. 2 is a perspective view of a tube header suited for the heat exchanger of FIG. 1.

FIG. 2 shows the general dimensions of a tube header 2 suited for the use in a heat exchanger 1 of the type shown in FIG. 1. The tube header 2 of FIG. 2 is shown from a side outside of a header box 6, which is the side from which, in the assembled state of FIG. 1, tubes 8 extend toward the second tube header 2 of a heat exchanger 1. In FIG. 2, the tubes 8 would extend upward. The tube header 2 is manufactured from cold-formed sheet metal, for example aluminum.

The length L and the width W of the tube header 2, constituting the two greatest dimensions of the tube header 2, define a header plane A. In the perspective of FIG. 2, the length L, forming the greatest dimension of the tube header 2, extends sideways along the image plane, and the width W extends into the image plane.

The tube header 2 has a generally rectangular outer periphery bordered by attachment portions in the form of flanges 20 extending along each of the four sides of the periphery for attaching the tube header 2 to the header box 6. From a central header plate 22 that extends in the header plane A, the flanges 20 extend transverse to the header plane A toward the header box 6 and are separated from each other by slots 24 in the four corners of the tube header 2 for added flexibility during assembly. Punched perforations 26 in the flanges 20 further add to the flexibility of the flanges 20.

The header plate 22 of the tube header 2 bears a row of ferrules 28 alternating with tie bars 30 or 44, respectively. The ferrules 28 surround elongated passages 12 extending along the direction of the width W of the tube header 2. The elongated passages 12 match the elongated cross-section of the tubes 8, with two opposing wide sides and two opposing narrow sides. Each of the ferrules 28 forms a wall 32 surrounding one of the passages 12. The wall 32 extends toward the interior of the header box 6.

The tie bars 30 and 44 provide a corrugation of the tube header 2 and thus provide increased stability for the overall structure of the tube header 2. To this end, the tie bars 30 are trough shaped and are arranged parallel to the passages 12. The bottoms 34 of the trough-shaped tie bars 30 point toward the outside of the header box 6. The tube header of FIG. 2 includes two of the tie bars 44, which are support tie bars for internal header baffles that separate the header into zones. The support tie bars 44 may also support other baffles that are disposed in the header box 6 for holding a distribution pipe or for similar purposes.

Below the tube header 2, a header gasket 54 is shown for illustration. The header gasket 54 has a gasket frame 56 that follows the general outline of the tube header 2. Gasket bridges are arranged across the gasket frame 56 that coincide with the locations of the support tie bars 44. The gasket bridges provide a seal between baffles and the tube header 2 as illustrated in more detail in FIG. 5. In each corner of the gasket frame, the header gasket includes gasket tabs 60 that cooperate with the slots 24 in the corners of the tube header to define the position of the gasket inside the tube header during assembly of the heat exchanger.

Figure 3:
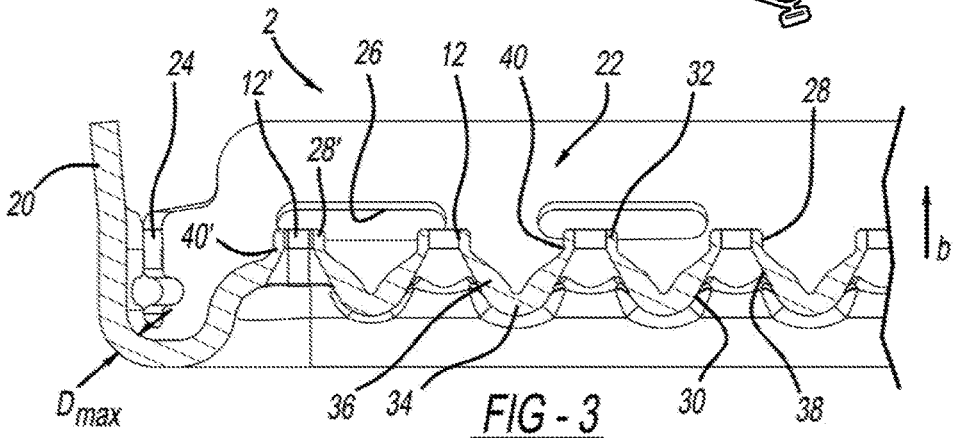
FIG. 3 is a cross-sectional detail view of the tube header of FIG. 2.
Figure 4A:
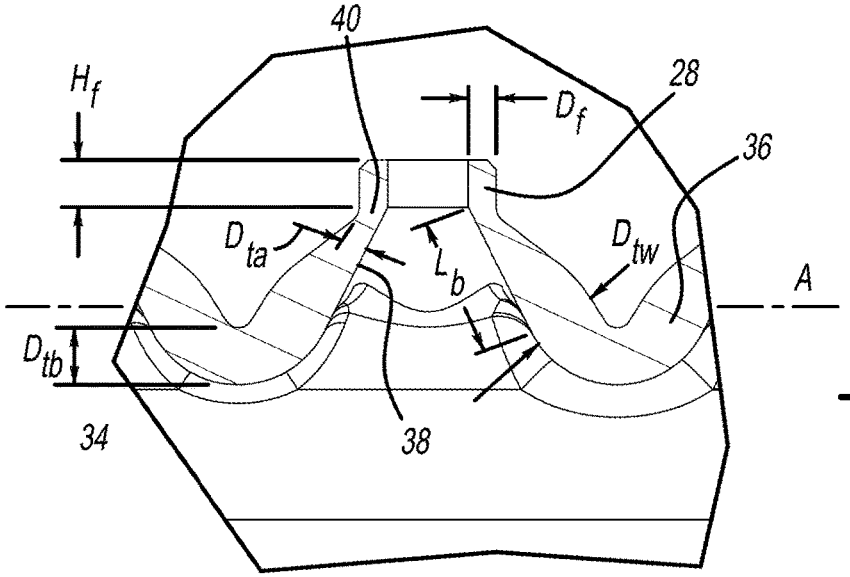
FIG. 4A shows a magnified detail of FIG. 3.
Figure 4B:
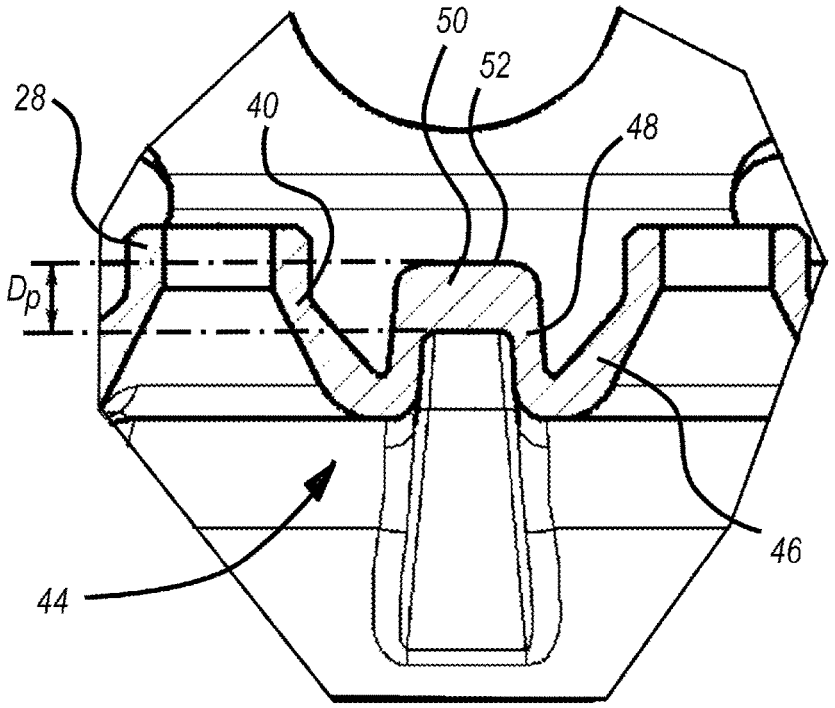
FIG. 4B shows a magnified detail of a generally W-shaped tie bar in a cross-section across the length of the tube header.

FIG. 3 shows a partial cross-section of a tube header 2 as shown in FIG. 2, with an enlarged detail shown in FIGS. 4A and 4B. The partial cross-section of FIG. 3 only shows trough-shaped tie bars 30. The support tie bar 44 is shown in FIG. 4B and in FIG. 5.

Referring to FIG. 3, the tube header 2 is composed of the header plate 22, the flanges 20, and the ferrules 28. The header plate 22 includes the row of oblong passages 12 extending through the header plate 22. Each passage 12 is bordered by a ferrule 28 monolithically formed with the header plate 22. Each of the ferrules 28 has a surrounding wall 32 extending perpendicular to the header plane A. Between adjacent passages 12, the header plate 22 includes the trough-shaped tie bars 30 alternating with the passages 12. The trough-shaped tie bars 30 provide additional dimensional stability to the tube header 2 via a corrugation effect. The tube header 2 has a maximum thickness $D_{max}$ that is present, for example, in an area where the header plate 22 transitions into the flanges 20.

Now referring to FIG. 4A, the ferrules 28 have a wall thickness $D_f$ that is smaller than the maximum thickness $D_{max}$ of the tube header 2. For example, the wall thickness $D_f$ of the ferrules 28 may be about 30% to 50% of the maximum thickness $D_{max}$ of the tube header 2. In contrast thereto, the trough-shaped tie bars 30 have side walls 36 with a local thickness $D_{tw}$ that may be equal to or only slightly smaller than the maximum thickness $D_{max}$. Preferably, the bottom 34 of the tie bar 30 has a reduced thickness $D_{tb}$ in comparison with the side walls 36.

The side walls 36 transition into a tapered portion 38 with a gradually reduced thickness toward the ferrule 28. Outside of the header box 6, the tapered portion 38 forms a steady slope over a taper length $L_t$ that is greater than the height $H_f$ of the ferrule 28, thus avoiding an abrupt change in the thickness of the header plate 22. The tapered portion 38 has a constant slope angle relative to the header plane A in a range of 45° through 80°, i.e. an angle of 10° to 45° relative to the tubes 8. Preferably, the slope angle is in a range of 60° through 66°, thus 24° through 30° relative to the direction of the tubes 8 shown in FIG. 5. At the transition from the tapered portion 38 to the ferrules 28, the thickness $D_{ta}$ of the tube header 2 has a minimum that is smaller than the thickness $D_f$ of the ferrule wall 32.

FIG. 4B shows a close-up cross-section of a support tie bar 44. The support tie bar 44 is generally W-shaped. It has two outer side walls 46 connected to the adjacent ferrules 28 via the transitional area 40. The support tie bar 44 further has two inner side walls 48. Each inner side wall 48 forms a V shape with one of the outer side walls 46. The inner side walls 48 are connected to each other via a central area 50 forming a plateau surface 52. The plateau surface 52 extends parallel to the header plane. the plane defined by the plateau surface intersects with the length of the ferrules 28. The central area 50 has a thickness $D_p$ that exceeds the thicknesses of the inner and outer side walls.

It is evident, that the inner side walls 48 and the central area form an inverted profile compared to the trough-shaped tie bars 30. It may thus fittingly be called a reverse tie bar. The tie bar creates a sealing surface for a bridge of a radiator gasket to bear against whilst being compressed by the baffle of a multi-zone heat exchanger tank. This design may, for example, be manufactured by using a pierced and drawn stamping technique or a lanced stamping technique.

In the example shown, the inner side walls 48 have an average thickness that is smaller than the average thickness of the outer tie bars 46. Thus, in the support tie bars, the inner side walls function as live hinges for increased flexibility along the length of the header plate, while the center area provides increased rigidity along the width of the header plate.

Figure 5:
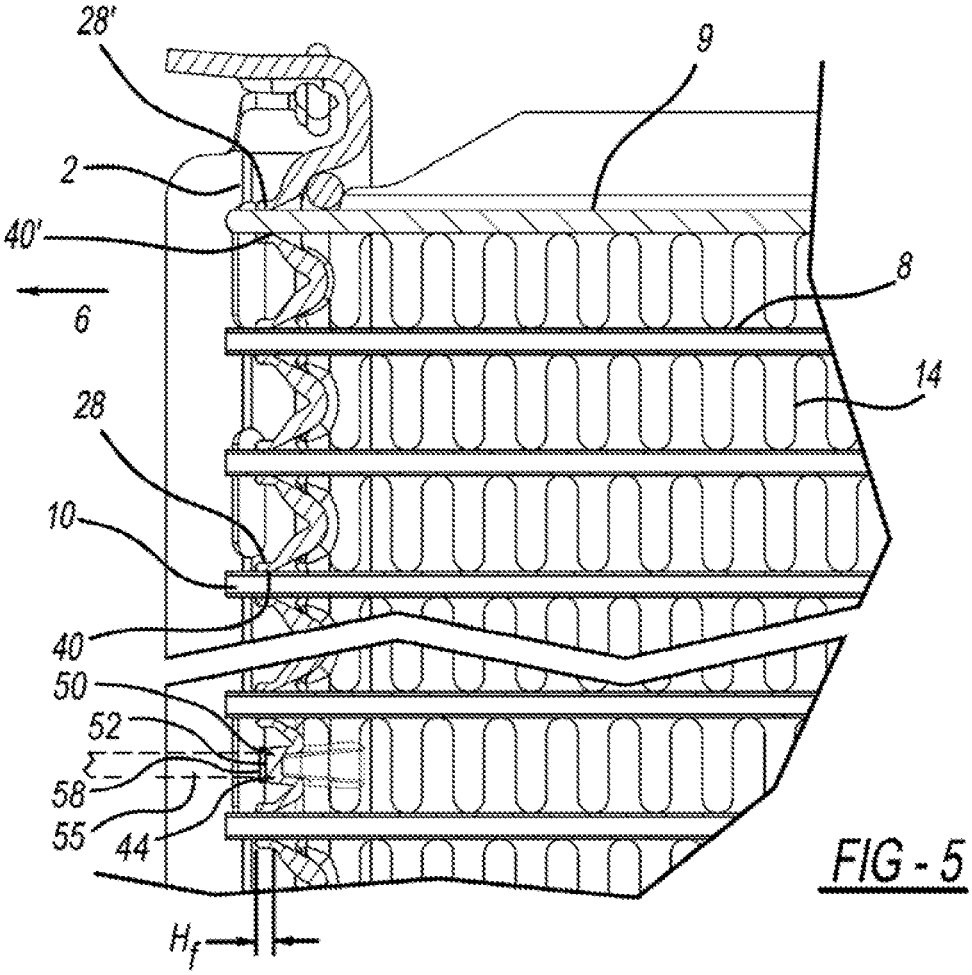
FIG. 5 shows a cross-sectional detail view of FIG. 3 with tubes inserted and with a schematically indicated baffle.

FIG. 5 shows a cross-sectional view corresponding to FIG. 3, but with tubes 8 attached to the tube header 2. Between the tubes 8, serpentining cooling fins 14 provide large cooling surfaces. The tubes 8, which have elongated cross-sections, are carried in the ferrules 28 of the tube header 2 and extend beyond the ferrules 28 into the interior of the header box 6. The tubes 8 extend past the free ends of the ferrules 28 by a length that is at least equal to the height $H_f$ of the ferrule 28. The transitional area 40 between ferrule 28 and tapered portion 38 is the area where the tube transitions from contacting the ferrule 28 with the tube surface to being out of contact with the tube header 2. Thus, the minimum thickness $D_{ta}$ (see FIG. 4A) of the tube header 2 is located in the transitional areas 40 directly adjacent the ferrules 28 making contact with the tubes 8. The added flexibility of the reduced thickness $D_{ta}$ provides for better compensation of thermal stress. The tubes 8 are brazed to the ferrules 28. The tubes 8 are joined together with the ferrules 28 by melting a filler metal with a lower melting point and making it flow into the overlapping length, thereby creating a fluid-tight connection.

FIG. 5 includes the trough-shaped tie bars 30 as well as one of the support tie bars 44. Indicated by a broken line is an internal header baffle 55. The internal header baffle 55 is supported by the support tie bar 44 via the gasket bridge 58. During assembly of the tube header with the header tank 4, the gasket bridge 58 is compressed by the internal header baffle 55 to form a fluid-tight seal.

Figure 6:
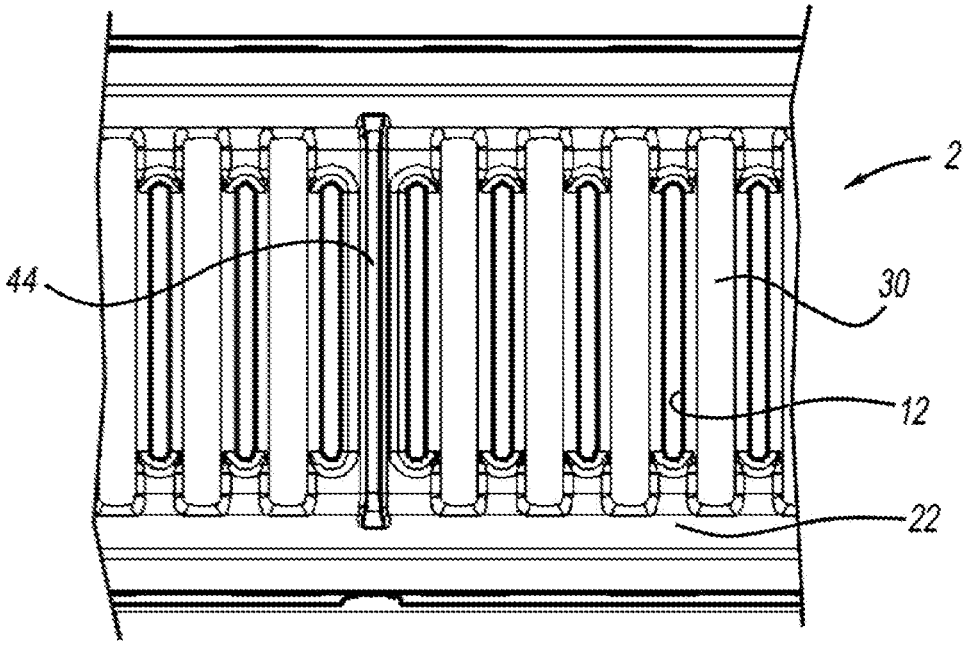
FIG. 6 illustrates a detail view of a first embodiment of a tube header according to FIG. 2.
Figure 7:
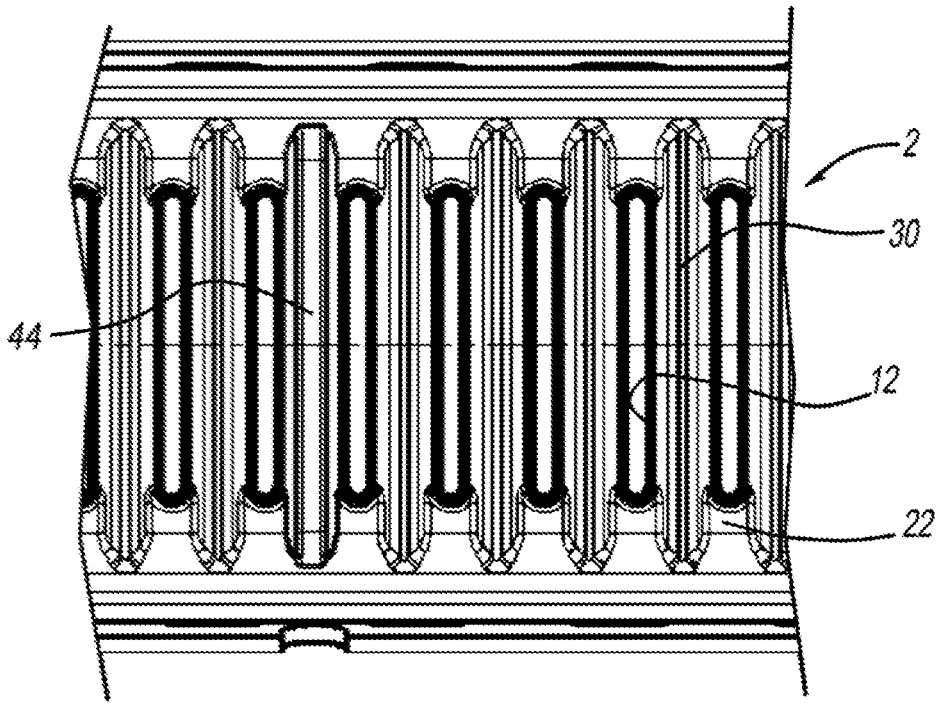
FIG. 7 illustrates a detail view of a second embodiment of a tube header according to FIG. 2.

FIGS. 6 and 7 show partial view onto a tube header 2 from the outside of the header box 6 and from the inside of the header box. While the trough-shaped tie bars 30 and the support tie bar 44 extend generally across the entire header plate 22, the passages 12 for inserting the tubes 8 may occupy varying portions of the width of the header plate 22.

FIG. 6 shows an example, in which the wide sides of the passages 12 occupy a little more than half of the width of the tube header 2. FIG. 6 shows the tube header from the tube side, which means that the tubes would extend from the tube header toward the viewer. FIG. 7 provides a view of the same tube header 2 as in FIG. 6, but the tube header 2 is shown from the header side. This means that the tubes extend away from the viewer. has a significantly greater width W than the length of the wide sides of passages 12.

Figure 8:
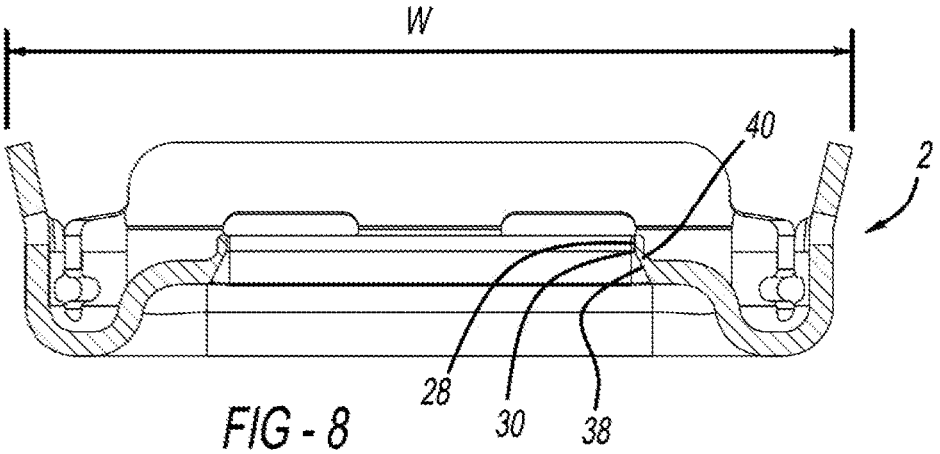
FIG. 8 is a cross-sectional view of the tube header illustrated in FIG. 6.

One of the passages 12 of this arrangement is shown in a cross-sectional view in FIG. 8. In FIG. 8, the ferrules 28, transitional areas 40, and tapered portions 38 are very similar to those shown in FIGS. 3-5. FIG. 8 provides a view in the third dimension, i.e. in a plane perpendicular to both the plane of FIGS. 3-5 and to the plane of FIGS. 6 and 7.

Figure 9:
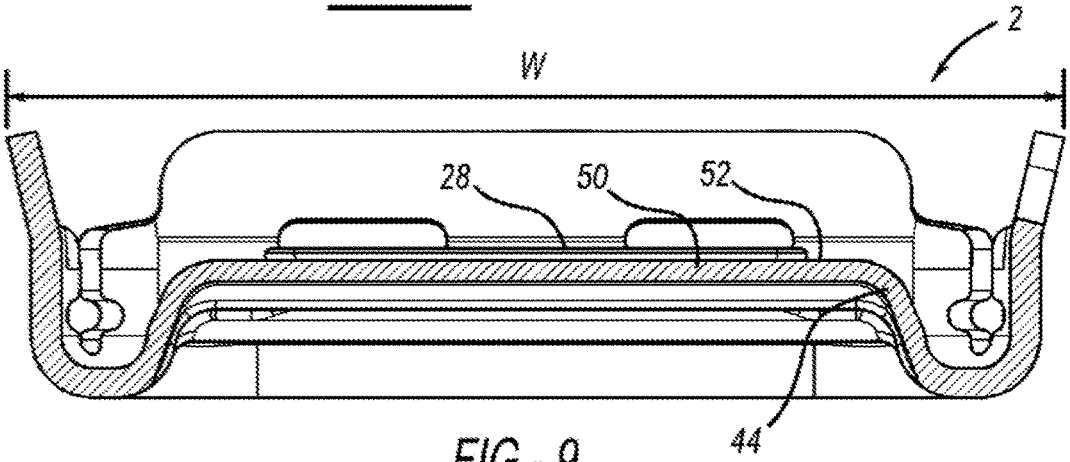
FIG. 9 is a view of the tie bar of FIG. 4B in a cross-section across the width of the tube header.

FIG. 9 shows a cross-section through the support tie bar 44. Behind the plateau surface 50, a portion of a ferrule 28 is visible. The plane of the plateau surface thus intersects the ferrule. The plane of the plateau surface 50 may, however be located above or below the ferrule if desired. Also, the thickness of the central area 50 may be varied based on requirements.

Figure 10:
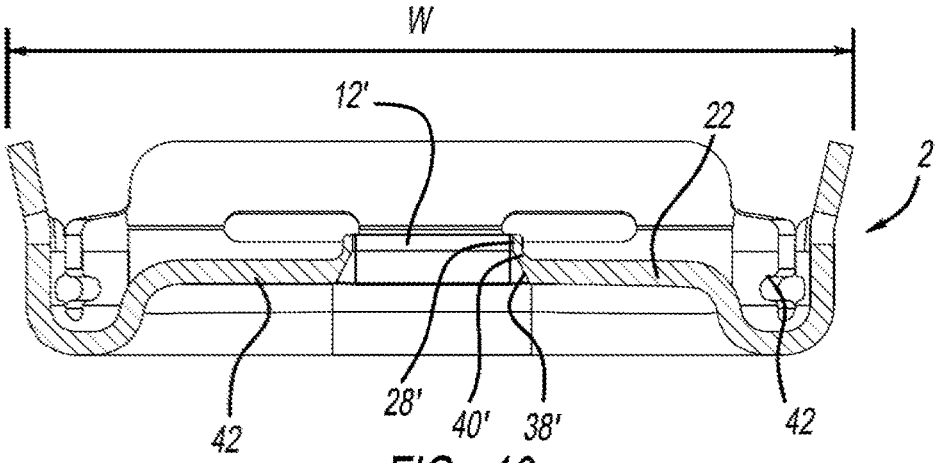
FIG. 10 is a cross-sectional view of the tube header of FIGS. 6 and 8 in a plane through an outermost ferrule.

FIG. 10 shows a cross-section of the tube header 2 of FIGS. 6 and 8 through one of the ferrules 28' surrounding the passage 12' that forms the end of the row of passages 12 and 12' (see FIG. 3). Instead of a tube, the ferrule 28' holds a core cover 9 (see FIGS. 1 and 5). Core covers are formed sheets of metal, for example aluminum, on each side of the heat exchanger 1. In the shown version of the header 2, the ferrule 28' is generally shaped like the ferrules 28 holding the tubes 8, but with a shorter wide side, i.e. a smaller dimension in the direction of the width W. The transitional area 40' forms a minimum thickness between the ferrule 28' and the taper 38'. Thus, flexible hinges are provided not only for the tubes 8, but also for the core covers 9. In this first embodiment of the tube header 2, the passages 12' for the core cover 9 are arranged centrally in the header plate 22 with respect to the width W, like the passages 12 of FIGS. 6 through 8. The ferrule 28' for the core cover 9 of the second embodiment would be arranged in alignment with the row of passages 12 and thus would be offset from the center of the tube header 2 with respect to the width W.

For the core covers, the ferrule design of FIG. 10 is optional. For example, the ferrules may not require any significant thinning of the transitional area 40'. Furthermore, the ferrules 28' for the core covers may have a similar width as the ferrules 28 of the tubes. Alternatively, in an embodiment not shown, the core covers may not be inserted into ferrules at all, but wrapped around the ends of the heat exchanger so that the passages 12' and the ferrules 28' for the core covers 9 may be omitted. These variations and variety of other possibilities for attaching the core cover to the heat exchanger are within the scope of the present invention.

All of the embodiments described above have in common that the tapered portion 38 is present around the entire periphery of the passages 12, along the wide sides of the passages 12 as well as along the narrow sides. The tapered portions 38 formed on the narrow side and the wide side serve as insertion aids in the fashion of funnels facing in the insertion direction of the tube. Thus, the tapered portions 38 assist the installation of the tubes 8 in the ferrules 28. The embodiments further have in common that the ferrule 28 has a greater wall thickness $D_f$ than the transitional area 40 $D_{ta}$ both along the wide sides of the passages 12 and along the narrow sides. As these embodiments show, the tube headers 2 as presented may be modified to meet various dimensional specifications. For applying the varying thicknesses of the tube header 2 and forming the passages 12 surrounded by the ferrules 28, for example, a pierced or lanced stamping technique may be utilized.

In one example, the maximum thickness of the tube header 2 may be 1.2 mm. The thickness of the bottom 34 of the tie bar 30 may be about 0.8 mm, the side walls 36 about 1.1 mm, the ferrules 28 about 0.6 mm, and the thickness of the transition between the tapered portion 38 of the header plate 22 and the lower edge of the tie bar 30 may be about 0.5 mm. The central area 52 of the support tie bar 44 may be close to the maximum header thickness. Generally, the central area 50 is preferably thicker than the inner side walls 48 of the support tie bar (see FIG. 4B). These measurements may be varied. For example, the transitional area 40 may have a greater thickness. In turn, the thickness of the ferrule 28 would then increase accordingly.

The transitional area 40 between the ferrules 28 and the header plate 22, where the tube would meet the tube header 2, is dimensioned to promote flexibility in the ferrule 28 and removes rigidity of the interface between the tube and the tube header 2 so that more stress can be transferred from the tube to the ferrule 28 during thermal cycling. The tie bar between the ferrules 28 also incorporates flexibility due to the reduced thickness of the bottom 34 for optimal thermal cycle performance, while adding dimensional stability against warping for improved pressure cycle performance. Both thinned areas in the transition between ferrules 28 and header plate 22 as well as at the bottom 34 of the trough-shaped tie bars 30 provide flexible hinges.

Tube headers 2 for radiators are typically available in a range of maximum thicknesses of 1 mm through 2.5 mm. The minimum thickness of the tube header according to the present application is in the transitional area 40 between the ferrules 28 and the tapered portion 38. The inner side walls of the support tie bar may have a thickness near the minimum thickness, preferably slightly greater than the transitional area. The average durability of the heat exchanger needs to meet customer specifications, and the performance should be satisfactorily consistent among heat exchangers 1 of identical build.

It has been found that the performance of the tube headers 2 was optimized when the thinning of the transitional areas 40 amounted to a minimum thickness between 0.3 mm and 0.6 mm, corresponding to a thickness reduction by 50% through 75% for a maximum thickness of 1.2 mm, to a reduction by 60% through 80% for a maximum thickness of 1.5 mm, and to a reduction by 70% through 85% for a maximum thickness of 2 mm.

The resulting thickness for the inner side walls of the support tie bar thus ranges between 20% and 50% of the maximum thickness, while the thickness of the central area of the support tie bar may be in the range of 60% through 100% of the maximum thickness.

The indicated ranges are approximate. In particular, the lower limit depends on manufacturing tolerances. If the minimum thickness is too small, the manufacturing tolerances may result in a locally fragile transitional area, while thicknesses too great may not provide the desired hinge function.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. A tube header for a heat exchanger, the tube header comprising a header plate having two major dimensions defining a header plane, the header plate having a row of oblong passages extending through the header plate, and a plurality of tie bars, each tie bar arranged between a pair of adjacent oblong passages, wherein at least one of the tie bars is a support tie bar with a W-shaped support tie bar profile in a cross-section across the row of oblong passages, and the support tie bar has a center area forming a plateau surface and connecting two V-shaped portions of the support tie bar profile, and wherein each of the V-shaped portions of the support tie bar profile has an outer tie bar side wall connected to an adjacent ferrule and an inner tie bar side wall connected to the center area, the inner tie bar side wall has a reduced thickness compared to an adjacent portion of the outer tie bar side wall to form a live hinge, and the outer tie bar side wall has a tapered portion with a transitional area adjacent to the ferrule, the transitional area having a reduced thickness compared to a wall thickness of the ferrule for flexibility, the tapered portion having a gradually reduced thickness toward the transitional area.

2. The tube header of claim 1, wherein each passage is bordered by the ferrule monolithically formed with the header plate.

3. The tube header of claim 2, wherein the ferrule has a length perpendicular to the header plane and wherein the plateau surface defines a plateau plane intersecting the length of the ferrule.

4. The tube header of claim 1, wherein in an installed position, the center area is located farther inside the tube header than an outermost portion of the support tie bar.

5. The tube header of claim 1, wherein the center area has a center area thickness forming a maximum thickness of the support tie bar.

6. The tube header of claim 1, wherein in an installed position, the plateau surface supports an internal header baffle extending perpendicular to the header plane.

7. The tube header of claim 6, wherein a gasket bridge is sealingly disposed along the support tie bar and forms a seal between the support tie bar and the internal header baffle.

8. The tube header of claim 1, wherein between the remaining adjacent passages, the header plate includes trough-shaped tie bars with a V-shaped profile.

9. The tube header of claim 1, wherein each passage is bordered by the ferrule monolithically formed with the header plate, the ferrule having a surrounding wall extending perpendicular to the header plane and having the wall thickness; and the transitional area between the ferrule and adjacent tie bars having the reduced thickness that is smaller than the wall thickness of the ferrule.

10. The tube header of claim 9, wherein the center area has a center area thickness that is greater than the wall thickness of the ferrule.

11. The tube header according to claim 9, wherein the reduced thickness of the transitional area amounts to at most 50% of a maximum thickness of the tube header.

12. The tube header according to claim 9, wherein between other adjacent passages, the header plate includes at least one trough-shaped tie bar with a V-shaped profile, wherein the trough-shaped tie bar has side walls with a side wall thickness ($I_D$) that is greater than the wall thickness ($I_D$) of the ferrules.

13. The tube header according to claim 9, wherein the trough-shaped tie bar has a bottom thickness that is smaller than the side wall thickness.

14. The tube header according to claim 1, wherein the header plate has at least one attachment portion for affixing the tube header to a header tank, the attachment portion extending perpendicular to the header plane in the same direction as the ferrules.

15. A heat exchanger with at least one header box and a plurality of tubes extending therefrom, the header box comprising a tube header having:

a header plate defining a header plane with a row of oblong passages extending through the header plate, a plurality of tie bars, each tie bar arranged between a pair of adjacent oblong passages, wherein at least one of the tie bars is a support tie bar with a W-shaped support tie bar profile in a cross-section across the row of oblong passages, and the support tie bar has a center area forming a plateau surface and connecting two V-shaped portions of the support tie bar profile, and wherein each of the V-shaped portions of the support tie bar profile has an outer tie bar side wall connected to an adjacent ferrule and an inner tie bar side wall connected to the center area, the inner tie bar side wall has a reduced thickness compared to an adjacent portion of the outer tie bar side wall to form a live hinge, and the outer tie bar side wall has a tapered portion with a transitional area adjacent to the ferrule, the transitional area having a reduced thickness compared to a wall thickness of the ferrule for flexibility, the tapered portion having a gradually reduced thickness toward the transitional area.

16. The heat exchanger according to claim 15, wherein the tubes are folded sheet metal tubes.

17. The heat exchanger according to claim 15, wherein the adjacent ferrule has a length perpendicular to the header plane and terminates in a remote edge at a free end, wherein the plateau surface defines a plane intersecting the length of each ferrule.

18. The heat exchanger according to claim 15, further including an internal header baffle supported by the support tie bar.

19. The heat exchanger according to claim 18, further comprising a header gasket with a gasket frame and at least one gasket bridge extending parallel to and in contact with the support tie bar and in contact with the internal header baffle, wherein the gasket bridge forms a seal between the internal header baffle and the support tie bar.

* * * * *